United States Patent [19]

Berney

[11] 3,949,592

[45] Apr. 13, 1976

[54] APPARATUS FOR MEASURING THE RUNNING OF WATCHES

[76] Inventor: Jean Claude Berney, Chemin des Croix-Rouges 3, Lausanne, Switzerland

[22] Filed: Jan. 30, 1975

[21] Appl. No.: 545,709

[30] Foreign Application Priority Data

Jan. 31, 1974 Switzerland ..... 1315/74

[52] U.S. Cl. ..... 73/6

[51] Int. Cl.[2] ..... G04D 7/12

[58] Field of Search ..... 73/6

[56] References Cited

UNITED STATES PATENTS

| | | | |
|---|---|---|---|
| 3,756,066 | 9/1973 | Bollinger | 73/6 |
| 3,811,315 | 5/1974 | Kunitomi | 73/6 |
| 3,817,083 | 6/1974 | Jucker | 73/6 |

*Primary Examiner*—S. Clement Swisher
*Attorney, Agent, or Firm*—Haseltine, Lake & Waters

[57] ABSTRACT

Apparatus for measuring the running of watches comprising an oscillator delivering a precise frequency *fr* coupled to a divider delivering a frequency *fd*, the mean value of the frequency *fd* being synchronized on a whole number multiple *n* of the frequency to be measured *fm*, by means of an on-off comparator which delivers a voltage +V and switches the rate of division of the divider to a value of X−Y when the signal of frequency *fm* is ahead of frequency *fd* or delivers a voltage −V and switches the rate of division of the divider to X + Y when the signal of frequency *fm* is behind the frequency *fd*. The output voltage of the comparator is applied to a resistor-capacitor network in such manner to obtain the mean value of this voltage, the mean value being proportional to the relative difference of frequency $(fm - fmo)/fmo$, where $fmo = fr/nx$.

8 Claims, 1 Drawing Figure

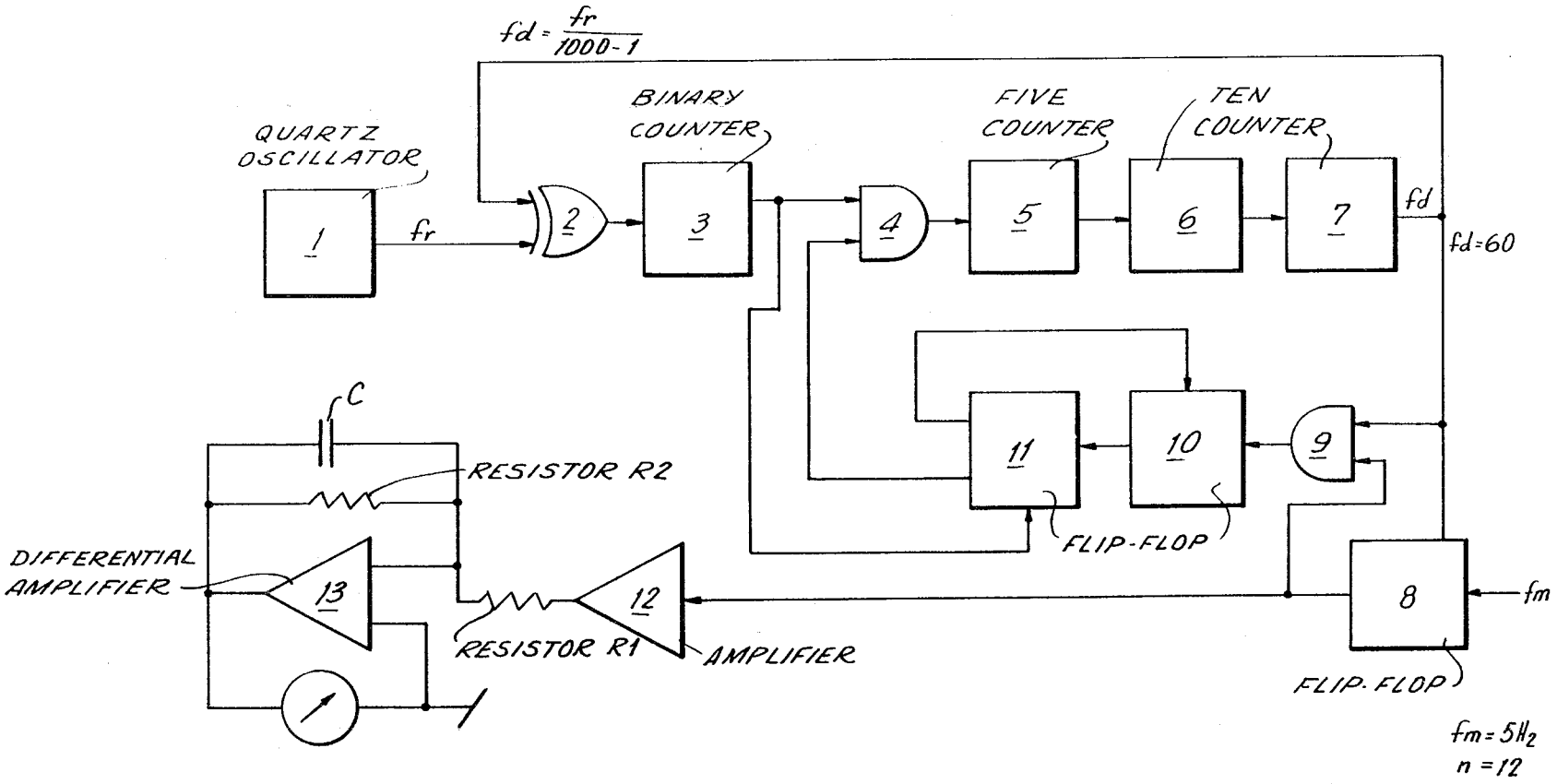
QUARTZ OSCILLATOR
1
fr
2
BINARY COUNTER
3
4
FIVE COUNTER
5
TEN COUNTER
6
7
fd
fd=60
fd = fr/1000-1
8
fm
fm=5½
n=12
FLIP-FLOP
9
10
11
FLIP-FLOP
12
AMPLIFIER
RESISTOR R1
RESISTOR R2
C
13
DIFFERENTIAL AMPLIFIER

APPARATUS FOR MEASURING THE RUNNING OF WATCHES

FIELD OF THE INVENTION

The invention relates to apparatus for measuring the running of watches by comparison of the frequency of the watch with a standardized source.

BACKGROUND

There exist at the present a number of devices for measuring the running of watches. The best known is the chronograph comparator which allows printing, on a band of paper, the phase difference between an internal reference frequency and the measured frequency obtained from the watch by a micromotor.

The variations of this difference can be read on a scale which indicates the running of the watch. This reading must be effected by an operator which limits the use of this apparatus in automated installations.

There also exists apparatus having digital display, and sometimes analog, which after having preliminarily placed the two frequencies in phase, measures and memorizes the phase difference between them over a determined period of time. Such apparatus is very sensitive to parasitic conditions of detection and to the perturbations of mechanical watches.

SUMMARY OF THE INVENTION

An object of the invention is to provide apparatus which permits obtaining an analog voltage signal proportional to the difference between the frequency of the watch and the internal reference frequency, this voltage being able to be directly introduced into a calculator or an automated system. Furthermore, it is little sensitive to the parasitic conditions of detection and to the perturbations of the watch.

According to the invention, this apparatus comprises an oscillator delivering a precise frequency *fr* followed by a divider delivering a frequency *fd*, the mean value of the frequency *fd* being synchronized on a whole number multiple *n* of the frequency to be measured *fm*, by means of an on-off comparator which delivers a voltage +V and switches the rate of division of the divider to a value of X-Y when the signal of frequency *fm* is ahead of frequency *fd* or delivers a voltage −V and switches the rate of division of the divider to X + Y when the signal of frequency *fm* is behind the frequency *fd*, the said output voltage of the comparator being applied to a resistor-capacitor network in such manner to obtain the mean value of this voltage, this means value being proportional to the relative difference of frequency $(fm - fmo)/fmo$ where *fmo* is equal to $fr/nx$.

The value of this difference can therefore be seen on a voltmeter graduated for example, in seconds per day, the voltage + V being equal to the error Y/X.

BRIEF DESCRIPTION OF THE DRAWING

The single figure of the drawing shows, by way of example a schematic circuit according to the invention.

DETAILED DESCRIPTION

An oscillator 1 of precise frequency *fr* controls an OR EXCLUSIVE gate 2 whose output is connected to a divider by two (binary counter) 3. This controls an AND gate 4 whose output is connected to a divider by five 5 followed by two dividers by ten 6 and 7. The output of divider 7, of frequency *fd* is connected to the second input of the OR exclusive gate 2. This has the effect of shifting its output 180° each time that the voltage of the output of divider 7 changes state or two times per output cycle (0 to 1 and 1 to 0). The total phase shift per cycle is therefore 360° which returns to add one pulse per cycle. The rate of division $T_1$ thus obtained is:

$$T_1 + 1 = X \qquad X = \text{total rate of division of dividers 3,5,6, and 7: } 2 \cdot 5 \cdot 10 \cdot 10 = 1000$$

$$T_1 = X - 1$$

$$fd_1 = \frac{fr}{X\left(1 - \frac{1}{X}\right)}$$

The output of the divider 7 is also connected to the input of an AND gate 9 and to the input *d* of a flip-flop 8, which receives at its watch input the signal whose frequency *fm* is to be measured, whereas its output is connected to the second input of the AND gate 9. It is established that when the output of the flip-flop 8 is zero, the gate 9 is blocked. The rate of division remains as $T_1 = X - 1$. In contrast, when the output of flip-flop 8 is 1, gate 9 is opened and the frequency *fd* appears at its output. This is fed to a flip-flop 10 which is connected to the input *d* of flip-flop 11 which receives at its watch input the inverse output of binary counter 3 while its direct output controls the setting to zero of the flip-flop 10 and its inverse output controls the blockage of the AND gate 4. It follows that each time the output of divider 7 passes from 0 to 1 one pulse is eliminated at the input of the divider 5. The disposition is valid for flip-flops 11 and 10 and dividers 5, 6 and 7 which react on the positive wavefront of their watch signal. The new rate of division $T_2$ thus obtained when the output of the flip-flop 8 is at 1 is:

$$2\left(\frac{T_2 + 1}{2} - 1\right) = X$$

$$T_2 = X + 1$$

$$fd_2 = \frac{fr}{X\left(1 + \frac{1}{x}\right)}$$

$$fmo = \frac{fr}{n \cdot x}$$

If:

$$fmo\left(\frac{1}{1 - \frac{1}{x}}\right) > fm > fmo \cdot \left(\frac{1}{1 + \frac{1}{x}}\right)$$

The arrangement permits regulating the frequency *fd* to the value $n \cdot fm$, by the action of the flip-flop 8 which functions as an on-off comparator. In effect, when *fm* is ahead of *fd*, the pulse arrives at the instant when the output of divider 7 is at 0 and the flip-flop 8 is in 0 state and *fd* takes the value $$fd = \frac{fr}{X\left(1 - \frac{1}{x}\right)} > \frac{fr}{x}$$

*fm* will therefore become behind *fd* up to the instant when the pulse arrives when the voltage as the output of divider 7 is at 1. The flip-flop 8 changes to 1 state and *fd* becomes equal to $$fd = \frac{fr}{X\left(1 + \frac{1}{x}\right)} < \frac{fr}{x}$$

and then in continuation.

The output of the flip-flop 8 is connected to an amplifier 12 which delivers a voltage + V when its input is at 1 and a voltage −V when its input is at 0. The output of this amplifier is applied to a resistor $R_1$ which is connected to the input of a differential amplifier 13 to which a capacitor C and a resistor $R_2$ are connected in parallel. The reference input of the differential amplifier is zero.

Assuming that the value of C is very great, let us calculate the voltage Uc at the terminals of the capacitor when we have had $A_1$ periods of *fm* where *fm* was ahead of *fd* and $A_2$ periods of *fm* where *fm* was behind *fd*. The sum of the currents times the time is equal to 0;

$$\frac{Uc\,(A_1 + A_2)}{R \cdot fd} - \frac{A_1 \cdot V}{R \cdot fd} + \frac{A_2\,V}{R \cdot fd} = 0$$

$$Uc = \frac{A_1 - A_2}{A_1 + A_2} \cdot V$$

We can demonstrate that this value is proportional to $(fm - fmo)/fmo$, which represents the running error of the watch.

In fact, $$\frac{A_1 + A_2}{fm} = \frac{n \cdot A_1\,(x-1) + n \cdot A_2(x+1)}{fr}$$

$$fm = fr \cdot \frac{A_1 + A_2}{n \cdot A_1\,(x-1) + n \cdot A_2\,(x+1)} \qquad fmo = \frac{fr}{n \cdot x}$$

$$\frac{fm - fmo}{fmo} = \frac{\dfrac{A_1 + A_2}{n \cdot A_1\,(x-1) + n \cdot A_2\,(x+1)} - \dfrac{fr}{n \cdot x}}{\dfrac{fr}{n \cdot x}} = \frac{A_1 - A_2}{X\left(A_1 + A_2 + \dfrac{A_1 - A_2}{x}\right)}$$

The last term in the parenthesis is negligible since X = 1000.

This equation is the same as that for Uc and one can replace $$\frac{A_1 - A_2}{A_1 + A_2} = X \cdot \frac{fm \cdot fmo}{fmo}$$

whereby $$Uc = \frac{fm - fmo}{fmo} \cdot X \cdot V$$

if: $(fm - fmo)/fmo = 1/x$ then $Uc = V$

It is interesting to note that the relation *n* between *fd* and *fm* does not introduce itself, nor does the duration of the measurement. It is necessary, however, to take into account the charge constant of capacitor C. This permits choosing a frequency *fd* which is suitable for a number of watch frequencies particularly 60Hz and its multiples.

With 60Hz one can measure in fact

| | | |
|---|---|---|
| 1 | Nz | n = 60 |
| 2 | Hz | n = 30 |
| 2.5 | Hz | n = 24 |

-continued

| | | |
|---|---|---|
| 3.0 | Hz | n = 20 |
| 4.0 | Hz | n = 15 |
| 5.0 | Hz | n = 12 |

It is well understood that one can choose any other values for *n*, *x*, and *y* under the condition that these remain whole numbers.

What is claimed is:

1. Apparatus for measuring the running of watches comprising oscillator means for delivering a precise frequency *fr*, divider means coupled to said oscillator for dividing *fr* by X and delivering a reference frequency *fd*, comparator means receiving a signal *fm* from the watch to be measured and to be compared with *fd*, said comparator means being connected to the output of the divider means for receiving *fd*, means operated by said comparator means and coupled to said divider means to switch the rate of division of the divider to a value X − Y when *fm* is ahead of *fd* and to X + Y when *fm* is behind *fd*, said comparator means delivering a voltage +V when *fm* is ahead of *fd* and a voltage −V when *fm* is behind *fd*, and output means coupled to said comparator means to obtain a mean value of voltage output of said comparator means which is proportional to the relative error in the watch signal compared to the reference signal *fd*.

2. Apparatus as claimed in claim 1 wherein said comparator means comprises an on - off comparator.

3. Apparatus as claimed in claim 2 wherein said on - off comparator is a flip - flop.

4. Apparatus as claimed in claim 1 wherein the comparison frequency *fd* is 60 Hz or a multiple thereof.

5. Apparatus as claimed in claim 1 wherein said output means comprises a resistor - capacitor network.

6. Apparatus as claimed in claim 1 wherein said divider means comprises a binary counter and counter means coupled to said binary counter.

7. Apparatus as claimed in claim 6 wherein said means operated by the comparator means for switching the rate of division comprises an OR exclusive gate ahead of said binary counter and having one input connected to said oscillator means, a second input connected to the output of said divider means and an output connected to said binary counter, an AND gate having one input connected to the output of the divider means, a second input connected to the output of the comparator means and an output, a second AND gate having an input connected to the output of the binary counter, a second input and an output connected to the input of said counter means, and means connecting said input of the second AND gate with the output of the first AND gate such that the latter controls opening of the former.

8. Apparatus as claimed in claim 1 wherein said output means is constructed to provide said mean value as equal to $(fm - fmo)/fmo$ wherein $fmo = fr/nx$, *n* being an arbitrary whole number wherein $n \cdot fd = fm$.

* * * * *